US005148493A

United States Patent [19]

Bruney

[11] Patent Number: 5,148,493

[45] Date of Patent: Sep. 15, 1992

[54] LOUDSPEAKER STRUCTURE

[76] Inventor: Paul F. Bruney, 12812 Meadowood Dr., Silver Spring, Md. 20904

[21] Appl. No.: 482,801

[22] Filed: Feb. 21, 1990

Related U.S. Application Data

[62] Division of Ser. No. 245,915, Sep. 19, 1988, Pat. No. 4,939,784.

[51] Int. Cl.[5] ..... H04R 25/00

[52] U.S. Cl. ..... 381/203; 381/204; 381/99

[58] Field of Search ..... 381/99, 100, 116, 117, 381/190, 191, 203, 204, 202

[56] References Cited

U.S. PATENT DOCUMENTS

| | | | |
|---|---|---|---|
| 4,410,063 | 10/1983 | Yasue et al. | 381/99 |
| 4,597,100 | 6/1986 | Grodinsky et al. | 381/99 |
| 4,653,103 | 3/1987 | Mori et al. | 381/99 |
| 4,703,509 | 10/1987 | Kanchev | 381/191 |
| 4,924,504 | 5/1990 | Burton | 381/202 |

FOREIGN PATENT DOCUMENTS

| | | | |
|---|---|---|---|
| 0242196 | 10/1986 | Japan | 381/116 |

OTHER PUBLICATIONS

Lafayette Catalog 700 (1970), p. 55, Speakers 21E47189 and 99E01174.

*Primary Examiner*—Forester W. Isen
*Attorney, Agent, or Firm*—Laubscher & Laubscher

[57] ABSTRACT

A dipole loudspeaker includes a rigid support containing an opening and a generally planar multi-layered flexible diaphragm mounted on the support and extending across the opening. The diaphragm is formed of a plurality of layers of thin flexible membrane material, each of the layers having a different height and containing a thin electrical conductor arranged in a predetermined pattern on one surface thereof. The conductor patterns on each of the membranes have different masses, whereby the membrane defines along its height areas of various thickness and varying mass whereby the membrane is suitable for more accurately reproducing or generating high and low frequencies when the electrical conductors are connected with a source of sound signal currents. A plurality of magnets are mounted in spaced relation opposite at least one surface of the membrane and the conductor patterns for vibrating the membrane to reproduce the sound in response to the sound signal currents through the conductor. The membrane and support are also designed to provide directionality and an accurate three-dimensional image of sound.

3 Claims, 5 Drawing Sheets

LOUDSPEAKER STRUCTURE

This application is a division of application Ser. No. 245,915, filed Sep. 19, 1988 now U.S. Pat. No. 4,939,784.

The present invention relates to improvements in loudspeakers, particularly dipole loudspeakers, and generally planar diaphragm electromagnetic loudspeakers. These improvements enable the production of low frequency sound of substantial amplitude from a diaphragm of relatively small area. In addition, the invention relates to improvements in a speaker of the membrane diaphragm type which provides full range sound reproduction characteristics, including excellent low frequencies response and three dimensional imaging owing to directionality at frequencies above 1400 Hz, in a speaker of relatively small size.

BACKGROUND OF THE INVENTION

Planer diaphragm electromagnetic loudspeakers are generally popular because of their good sound reproduction characteristics. Such loudspeakers typically include a generally flat diaphragm composed of a membrane having a pattern of one or more conductors thereon which form the "voice coil" or signal current carrying conductors. The membrane is positioned so that the conductors are located close to and in opposed relation to magnets, or a magnetic sheet, so that the conductors are attracted and repelled by the magnets as current signals pass through the conductors, thereby causing the membrane to oscillate and produce sound.

A typical planar diaphragm includes a thin flat membrane of MYLAR with a pattern of thin foil-like conductors on the membrane. Aluminum is a popular conductor material because of its light weight. This provides a rugged construction capable of withstanding high power input and transients without damage, since the resistance of the conductors is quite low and the area of heat dissipation of the conductors is quite large.

Planar diaphragm loudspeakers have good sound reproduction characteristics, particularly in the low frequency range. However, in order to produce low frequency sound of reasonable amplitude, it is necessary for the diaphragm to move relatively large amounts of air, which in the past has required high power input and a large diaphragm and thus, a correspondingly large speaker, because of the relatively short excursion or front to back movement of the diaphragm.

The short excursion resulted from the need to maintain the diaphragm at least slightly tensioned in its mid-plane position so it could not ripple or wave like a flag, and thus cause objectionable sound distortion. To avoid such ripple movement distortion, the diaphragms in the past have been tensioned, and then rigidly attached to a surrounding frame. Thus, the extent of excursion or movement at the center of the diaphragm was quite limited, because of the required low elasticity of the diaphragm material. A diaphragm with a large area was therefore needed, and high power input was required for high amplitude low frequency response, because of this short permissible excursion of the diaphragm.

Other problems encountered in the past with planar diaphragms related to the difficulty of obtaining full range sound reproduction, without the use of multiple separate diaphragms for low, mid-range, and high frequencies. Such separate diaphragms increase the cost of the loudspeaker construction, and usually require in addition, cross-over networks, and in many instances, matching impedences for one or more of the diaphragms. Such separate diaphragms have been used in the past because a relatively thick membrane diaphragm with relatively heavy conductors which are required to accurately reproduce low frequencies, has only fair mid-range response, and very poor high frequency response. Similarly, a thin membrane with light conductors to obtain good high frequency response cannot move sufficient air to reproduce the low frequencies, and a diaphragm with good mid-range response is usually deficient in both the bass and treble range.

Another problem with dipole loudspeakers, such as planar diaphragm speakers, is the need to space these speakers from a room wall behind the speaker to avoid reflections which distort the sound emanating from the front of the speaker.

A further problem has been distortion of different frequencies of sound produced by planar diaphragm loudspeakers.

SUMMARY OF THE INVENTION

Many of the shortcomings and problems of the prior loudspeakers, particularly planar diaphragm loudspeakers, are overcome with the present invention.

In accordance with one aspect of the invention, a planar diaphragm is so attached at its edges to a mounting frame or support that long excursion of the center of the diaphragm is obtained without ripple movement distortions, to produce high amplitude low frequencies. This is accomplished, where an effective portion of the diaphragm is rectangular, by mounting at least opposed portions of the diaphragm on flexible or resilient members which retain the edges of the diaphragm against any substantial movement normal to the plane of the diaphragm but enable the edges to move slightly inwardly toward each other so that the diaphragm does not ripple or wave like a flag during operation. This enables the center of the diaphragm to move, in a direction perpendicular to the relaxed plane of the diaphragm, a much greater distance than it can move if the edges are rigidly anchored. It can be shown that the increase in movement at the center of the diaphragm, within the presently known operable range, is at least 10 times the inward deflection of the edges.

An additional advantage of the flexible or resilient mounting at the edges of the diaphragm is increased efficiency, because the tension in the diaphragm does not greatly increase at maximum excursion. Correspondingly, less power is required to move the diaphragm this greater distance.

In accordance with another aspect of the invention, a single laminated diaphragm is provided which has different regions thereof tailored to reproduce respective low, mid-range, and high frequencies, so that the need for separate diaphragms and cross-over networks is eliminated. This is accomplished, in accordance with the invention, by laminating together membranes of different lengths each with thin foil-like conductors thereon, to form a single multi-layer diaphragm having different thickness regions, some with multi-layer superimposed and aligned conductors, for full range relatively flat sound reproduction.

The region of the diaphragm for reproducing treble or high frequencies can, for example, be a single thickness of the diaphragm membrane material, with thin narrow conductors thereon, to obtain the effect of a tweeter. The region of the diaphragm for reproducing bass or low frequencies can be composed of several layers of membrane material each with conductors thereon which are wider and/or thicker than the conductors of the tweeter section. The membrane material itself used in the bass portion of the diaphragm can also be wider and/or thicker than that used for the tweeter region. For mid-range sound, the number of layers (or thickness) is less than is required for bass, and the conductors can be narrower and/or thinner than those for the bass section. The membrane for the mid-range can be thinner than for the bass section and thicker than for the tweeter section.

As an alternative, the conductors in the bass and mid-range sound producing regions can all be of the same width, with multiple superimposed layers for bass, and fewer layers for the mid-range. The thickness of the conductors and the membrane can be greater for the bass.

The conductor patterns on the membrane sheets can be formed by any well-known techniques such as, for example, vapor deposition, or by laminating a foil sheet to the membrane followed by etching to provide the desired conductor pattern. In one preferred embodiment, the sheets are of different size and are laminated together to form a diaphragm of stepped thickness.

To facilitate forming the diaphragm, a large sheet of the diaphragm membrane with desired conductors arrays thereon can be formed, and then cut and laminated, jumpers being provided to connect the conductors on the different laminated layers.

Another way of forming the diaphragm, is to make a large sheet of the diaphragm membrane having a desired conductor thereon, and to then fold and bond the sheet to itself to obtain a two layer laminate. By folding the sheet only partly upon itself, both single layer and two layer regions are obtained, and jumpers can be eliminated by providing connecting conductors on the sheet which extend across the fold.

A large sheet can be folded unequally around another diaphragm sheet, to provide single layer, two layer, and three layer thickness diaphragm regions. Unequally folding a second sheet around an unequally folded first sheet provides regions of one, two, three and four layers. The sheets forming the laminated diaphragm can, of course, be individually formed, and bonded one on the other, and more connectors are then provided to electrically connect the conductors on the respective sheets to input leads of the speaker.

In accordance with another aspect of the invention, features referred to above are combined to permit long excursion of the multi-layer bass region of the diaphragm, lesser excursion of the mid-range region of the diaphragm, and still less excursion of the tweeter region.

In accordance with another aspect of the invention, the sound which is emitted from the rear of a bipolar loudspeaker, such as a flat diaphragm speaker, is tuned and filtered to enable the speaker to be placed very close to a room wall without rear reflection distortion of the output sound. This is accomplished by forming the support member as an acoustic filter. That is, the support is formed as a housing containing a chamber and containing openings in the front and rear walls thereof. The membrane is connected with the front wall of the housing and covers the opening and a layer of cloth or fabric is connected with the rear wall of the housing and covers the rear opening. The fabric obliquely reflects high frequency components from the rear of the housing and the chamber allows full excursion of the membrane.

In accordance with another aspect of the invention, the respective portions of the diaphragm which produce the bass, mid-range and high frequency sounds are each of a dimension greater than the wave length of the produced sound at frequencies greater than 1400 Hz. This enhances the sound direction perception of the listener so that separation of the sounds from each speaker of a stereo system is greatly enhanced, thereby providing three dimensional audio imaging.

Accordingly, an object of the invention is to provide an improved planar diaphragm loudspeaker for obtaining high amplitude low frequency response from a relatively small diaphragm, by providing for long excursion of the diaphragm.

Another object of the invention is to provided an improved diaphragm of laminated construction with regions thereof of different thickness and conductor width, for reproducing high, mid-range, and low frequencies.

According to another object of the invention, the laminated diaphragm is composed of sheets of different sizes to form diaphragm regions of different thickness.

Another object of the invention is to provide a diaphragm of laminated construction in which the widths and/or the thickness of the conductors can be different on different layers of the diaphragm, and in which the thickness of the membrane material of some of the layers is also different.

A further object is to provide a loudspeaker with a single planar diaphragm having different frequency reproducing portions, and in which the frame or support on which the diaphragm is mounted has an opening therein of an irregular configuration to complement the reproduction characteristics of the different frequency reproducing portions of the diaphragm.

A further object of the invention is to provide a bipolar loudspeaker with a tuning and filter arrangement which virtually eliminates rear reflection distortion so that the speaker can be placed very close to the wall of a room without obtaining such distortion.

Another object of the invention is to provide a loudspeaker of the planar diaphragm type in which frequencies above about 1400 Hz are reproduced by a diaphragm of a dimension at least as great as the wavelengths of the produced sound to obtain a distinct separation and directional perception of the sound, thereby providing three-dimensional audio imaging.

BRIEF DESCRIPTION OF THE FIGURES

Other objects and advantages of the present invention will become apparent from a study of the following specification when viewed in the light of the accompanying drawing, in which.

DETAILED DESCRIPTION

Figure 1:
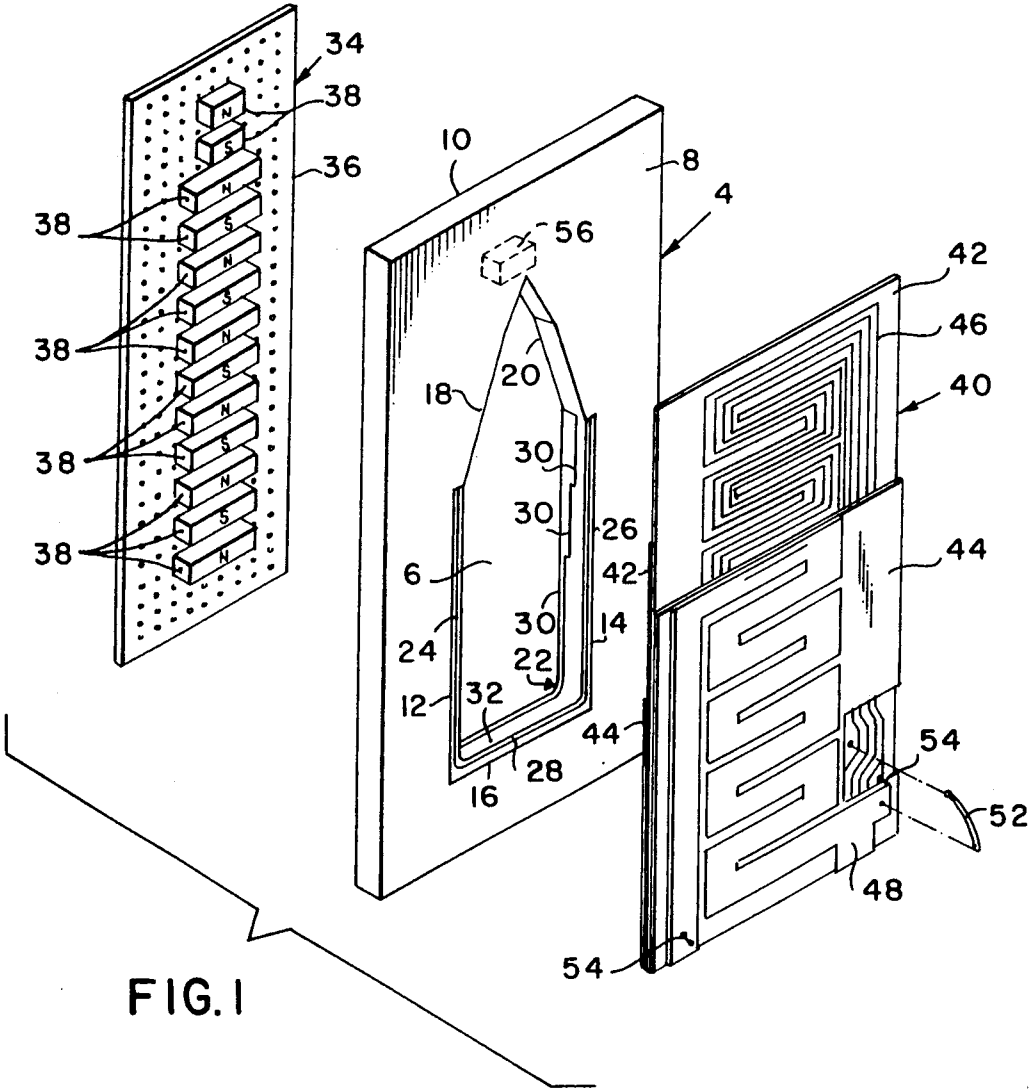
FIG. 1 is an exploded perspective view of a first embodiment of the loudspeaker according to the invention.
Figure 2:
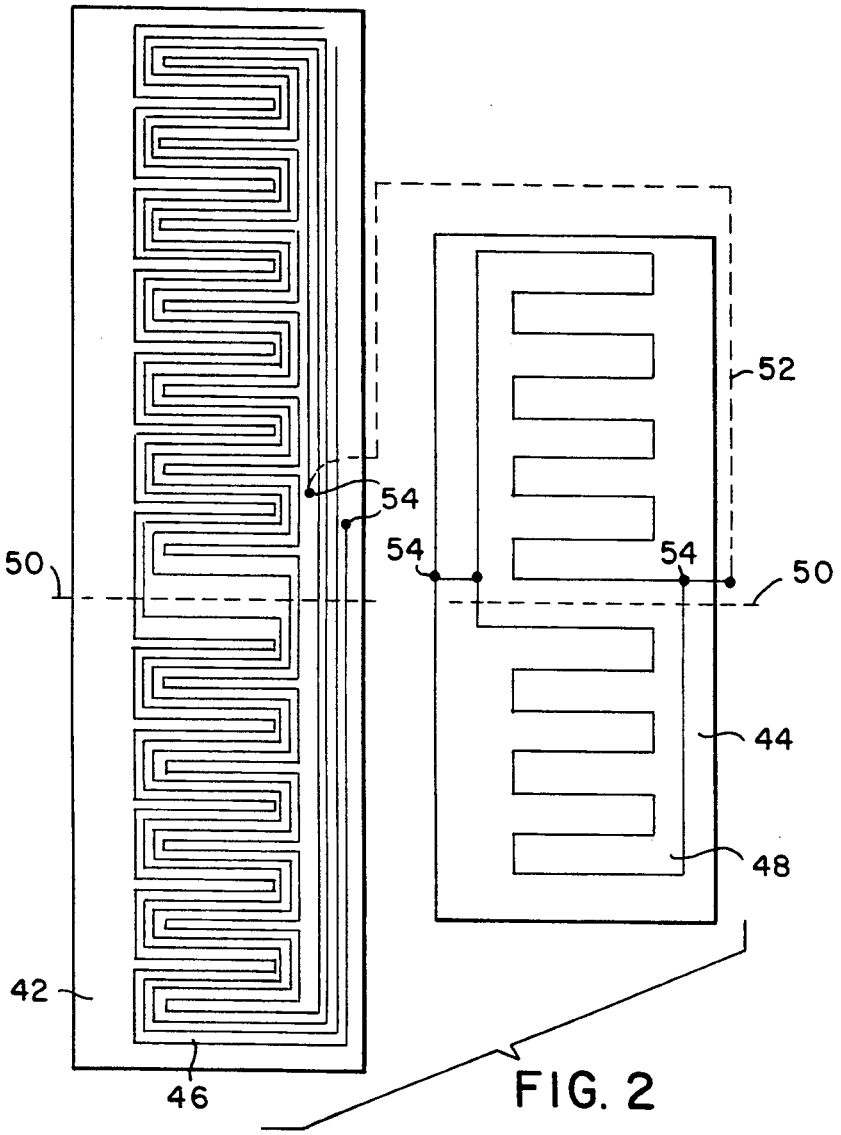
FIG. 2 is a plan view of first and second conductor patterns used on the flexible membrane according to the inventions.

FIGS. 1 and 2 show portions of an exemplary first embodiment of the loudspeaker according to the invention. The loudspeaker 2 includes a rigid rectangular diaphragm support 4 containing an irregular through opening 6. The support 4 is of generally uniform thickness and has a flat front face 8, and a flat rear face 10. The material of the support frame 4 can be particle board or other similar non-magnetic dimensionally stable rigid material such as plywood.

The opening 6 in the support 4 has a lower generally rectangular portion defined by parallel upright side edges 12, 14 and a straight bottom edge 16 and an upper generally triangular portion formed by tapered edges 18, 20 which meet at a peak. Thus, the through opening 6 is symmetrical about a vertical center line and decreases in width from the bottom edge 16 to the peak.

Formed in the front face 8 around the lower portion 16 of opening 6 is an L-shaped rabbet 22 with side walls 24, 26 and a bottom wall 28 which are parallel with and outwardly of the side edges 12, 14 and bottom edge 16 of opening 6, respectively. The depth of rabbet 22 between its bottom 28 and the front face 8 of the support 4 decreases in steps 30 from the bottom wall to the top walls, for a purpose which will be explained below.

A flexible connector is arranged in the edge of the rectangular portion of the opening 6. Preferably, this flexible connector comprises free-standing beads of silicone sealant or other elastic material 32 which is applied into the rabbet steps such that the stacked beads form a pliant wall of elastic material, the top of which lies flush and level with the front surface 8 of the support. Other suitable flexible connector means such as an elastic fabric may be substituted for the silicone sealant.

Connected with the rear face 10 of the support 4 is a magnet assembly 34 composed of a rigid sheet 36 of perforated magnetic material on which a plurality of vertically spaced rows of bar magnets 38 are mounted, so that they extend into the opening 6 toward the front face 8 of the support 4. The magnets are magnetized in a direction perpendicular to the front face 8 of the support 4, and each adjacent row of magnets is of a different magnetic polarity.

Mounted on the front face of the support 4 is a diaphragm 40 composed of a plurality of layers of thin membrane material 42, 44 such as MYLAR, each having a conductor pattern 46, 48 on one face. The layers are bonded together by an adhesive to form a multilayer diaphragm in which at least one layer of membrane material is between each successive conductor pattern to electrically insulate the respective conductor patterns one from another. The conductor patterns can be formed by any of the well-known techniques such as by vapor deposition or by laminating a foil sheet to the membrane followed by etching to provide the desired conductor pattern.

The lower portion of the diaphragm 40 is sealed around its side and bottom edges to the elastic sealant 32 of the support to provide a flexible connection of this portion of the diaphragm with the support 4. A bead of adhesive (not shown) is arranged on the front face 8 of the support about the edges 18, 20 to adhesively and thus securely connect the upper portion of the diaphragm with the support. In this manner, the diaphragm is suspended from the upper portion thereof, with the lower portion being elastically or flexibly connected with the support around the rectangular portion of the opening. Alternatively, only one side edge of the lower portion of the diaphragm need be elastically connected with the support, so long as lateral flexing of the diaphragm is afforded as will be developed below.

As shown in FIG. 2, the membrane comprises two unequal length MYLAR sheets 42 and 44 each of which contains dissimilar conductive foil paths 46 and 48, respectively, both having a generally zig-zag configuration. In order to form the membrane structure shown in FIG. 1, the two MYLAR strips are folded about the fold lines 50 in a back to back relation at the bottom edge and bonded together with appropriate adhesives. In this manner, the membrane 40 shown in FIG. 1 has areas along its height of varying thickness and containing varying conductive patterns. More particularly, the width and thicknesses of the conductive foil patterns 46 and 48 vary according to the frequency ranges they are intended to operate within when a signal sound source such as from an amplifier is connected with the conductive patterns. The longest conductor path 46 is made from 0.5 ml aluminum foil, portions of which are responsible for reproduction of the higher frequencies of the sound spectrum. For example, each of the paths of this conductive foil which comprise the tweeter area of the loudspeaker are subdivided into three parallel strips of ⅛ inch width. The four foil paths adjacent to the tweeter area are each subdivided into two parallel strips of 3/16 inch width. Conversely, conductive foil path 48 reproduces primarily lower frequencies and is 2 inches wide and 1 ml thick. Of course, these dimensions may be altered slightly from those set forth above depending upon the material and frequency range being provided by the loudspeaker.

It has been found that the increased thickness of the bass foil 48 creates an increased stiffness of the base area of the membrane which enhances the ability of the membrane to move uniformly over longer spans. Additionally, changing the thickness of the foil or the MYLAR sheet changes the ratio of conductor mass to total mass and can be used as a means to change the output and resonance of different portions of the membrane element. Thus, the lower portion of the membrane 40 which has a greater thickness as well as an increased mass of conductor patterns, is suitable for producing the lower frequencies from the loudspeaker and thus defines the bass region thereof, whereas the upper portion of the diaphragm contains only a single layer of MYLAR material and relatively thin conductor paths to reproduce the high frequency or tweeter output of the loudspeaker. The intermediate portion of the membrane which has a thickness between the upper and lower portions of the membrane is suitable for reproducing mid-range frequencies. An electrical connector 52 shown in FIGS. 1 and 2 is provided to electrically connect the conductor paths on each of the MYLAR sheets. This connector electrically connects contacts 54 provided on each of the conductors. Direct interconnection of the conductors may also be provided when the membrane is formed as a laminated assembly.

With the membrane 40 connected with the front face 8 of the support 4 and with the magnet assembly 34 connected with the rear face 10 of the support, the magnets 38 are arranged opposite the conductor patterns and oriented to conform to the shape of the conductive foil of the membrane. A recessed area 56 is provided in the support 4 to accommodate the top magnets associated with the tweeter area of the membrane element. When current from a sound signal source is applied to the conductors, the current running through the conductors causes the flexible membrane to be repelled and attracted relative to the magnetic fields of the magnets 38 causing excursion or in and out movement of the membrane relative to the opening 6 contained in the support to generate sound. Moreover, owing to the flexible connection of the side edges of the lower portion of the membrane, the membrane is enabled to move laterally across the lower portion thereof to further increase the excursion or displacement of the membrane thereby producing an even greater range of sound output. Since the width of the elastic material 32 is the same through-out its entire length, progressively increasing the height of the elastic material provides increasing flexure in the shear direction of the top of the elastic bead, and consequently increased flexure in the planar direction of the membrane, so that progressively longer base excursions are permitted with less variation in the membrane tension. At the same time, because the flexible connection bead has low flexure in the compression direction, the edge of the membrane cannot freely move normal to its planar direction, that is the edges cannot move in the excursion direction. This suppresses the tendency for the membrane edges to "break-up" during long excursions. With such a connection of the membrane to the support, excursion movement of the lower portion of the membrane is at least ten times greater than edge deflection of the membrane. Moreover, different excursion regions are provided across the height of the membrane, with excursion being greater in the lower bass regions and less in the upper treble regions.

Figure 3A:
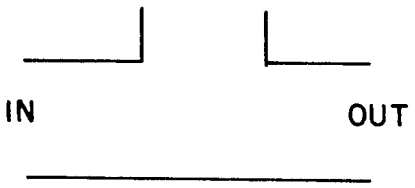
FIGS. 3*a* and 3*b* are schematic illustrations of hi-pass and band-pass acoustic filters.
Figure 3B:
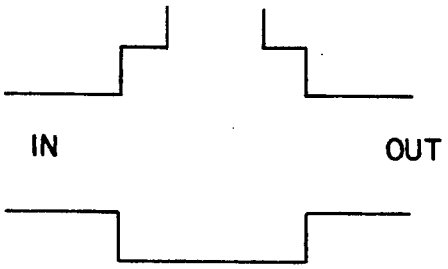
Figure 4:
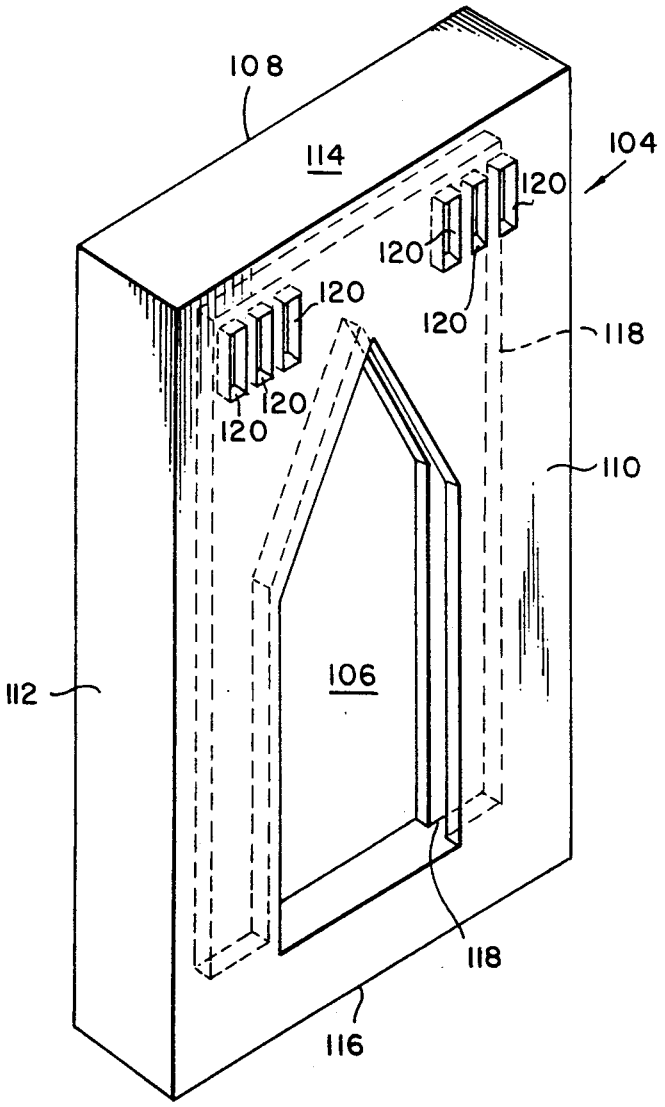
FIG. 4 is a rear perspective view of an alternative embodiment of the support structure of the loudspeaker of FIG. 1 providing an acoustic filter.
Figure 5:
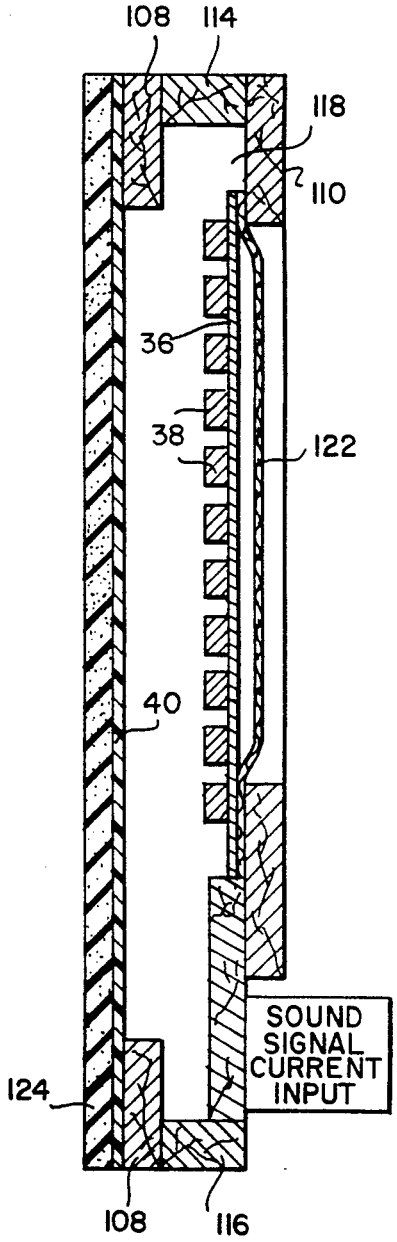
FIG. 5 is a side sectional view of a loudspeaker incorporating the support of FIG. 4.

Turning now to FIGS. 3, 4, and 5, a preferred embodiment of the invention will be described wherein a filter mechanism is provided for the support. First with reference to FIG. 3, there is shown a typical acoustic filter for sound passages that have dimensions which are small compared with the wave lengths to be affected. More particularly, FIG. 3*a* shows a hi-pass filter (which attenuates bass) and FIG. 3*b* shows a band-pass filter space (which attenuates both bass and treble frequencies). Using these principles, a suitable filter mechanism may be provided on the loudspeaker of FIG. 1 by modifying the support 4 as shown in FIG. 4.

The support 104 of FIG. 4 includes a front wall 108, a rear wall 110, side walls 112, a top wall 114 and a bottom wall 116 which define a chamber 118 therebetween. The front and rear walls of the support 104 each contain aligned openings 106 having a lower rectangular configuration and an upper triangular configuration which is similar to the configuration of the opening shown in the support 4 of FIG. 1. The openings 106 in the front and rear walls communicate with the chamber 118 of the support 104. A plurality of apertures 120 are provided in the rear wall 110 above the opening 106 and adjacent the top wall 114 and also communicate with the chamber 118. The chamber 118 thus acts as a filter mechanism for attenuating low frequencies without impeding long excursion of the diaphragm.

In lieu of separate front, rear, top, bottom, and side walls, the support may be formed of a unitary piece of wooden material which has a through opening provided therein as for example shown in FIG. 1, with the chamber portion being routed out of the interior of the solid piece of wooden material defining the support. The routed out chamber preferably would have a rectangular figuration similar to that shown in FIG. 4.

In FIG. 5, there is shown a vertical sectional side view of a preferred embodiment of the loudspeaker assembly wherein a baffle type support containing a chamber 118 as shown in FIG. 4 is provided with the remaining elements of the speaker. More particularly, the membrane 40 is connected with the front surface of the front wall 108 in a manner as described with regard to the embodiment of FIG. 1, and a magnet assembly 34 is connected with the front surface of the rear wall of the support. Arranged between the magnet assembly 34 and the rear wall 110 of the support is at least one layer of fabric or cloth material 122 such as burlap which acts as a reflector device for obliquely reflecting high frequency components from the rear of the loudspeaker. A suitable acoustically transparent grill cloth 124 is connected to the front face of the loudspeaker assembly as is known in the art. With the design of FIG. 5, the acoustic chamber does not impede excursion or motion of the diaphragm during operation of the speaker and does not "back-load" the diaphragm. The assembly of FIG. 5 also reduces reflection from rear surfaces such as walls and the like back through the diagram. The structure attenuates lower frequencies of rearwardly directed sounds so as to reduce both reflected and front-to-back low frequency sound cancellation around the edges of the baffle. Thus, the design not only attenuates reflections but also increases bass output and provides greater freedom for positioning the loudspeakers in a room.

In lieu of the one or more layers of the fabric material, louvers may be provided behind the diaphragm in the opening of the rear wall to obliquely reflect higher frequency components so as to discourage reflections from rear surfaces back through the diaphragm. The amount of open area behind the diaphragm is large enough so as not to impede the excursion motion of the diaphragm.

During stereo playback through loudspeakers, a maximum separation of frequencies above 1400–1500 Hz is necessary for accurate reproduction of three-dimensional cues. Wide dispersion of these frequencies by stereo loudspeakers suppresses dimensional cues, while beaming of these frequencies by carefully oriented directional stereo loudspeakers provides maximum separation and a consequent improvement in three-dimensional reproduction.

If the wavelength of a reproduced sound is longer than the width of the loudspeaker driver reproducing it, the emanating sound will be dispersed through a wide angle. If the wavelength of a reproduced sound is equal to or smaller than the width of the loudspeaker driver reproducing it, the sound will emanante as a directional beam. This characteristic can be utilized to create a loudspeaker that exhibits selective directionality (above 1400–1500 Hz) for improved three-dimensional reproduction.

The above characteristic dictates that, for all frequencies above 1400–1500 Hz, the loudspeaker driver (or drivers) must have a width which equals or exceeds the wavelengths of the frequencies which are reproduced. For example, if a driver has a width of 3.378", which is the 4000 Hz wavelength, the driver must be used to reproduce sounds at or above 4000 Hz.

While this size/frequency response relationship can be satisfied by light-weight cone or rigid panel loudspeaker designs, it is probably most easily embodied in designs where a relatively large, low mass membrane area can be used to reproduce higher frequencies as in the present invention. An example of a membrane and a cone design are provided, but many other variations, both with and without crossover networks, are possible.

In the upper triangular region of the membrane loudspeaker shown in FIG. 1, even though the foil conductors are bonded to a common membrane, each conductor behaves somewhat as a separate loudspeaker driver. The length of each conductor/driver across the opening in the support determines the maximum desired wavelength of reproduced frequencies for that conductor. Both the span length and the combined masses of the foil, MYLAR, and adhesive determine the natural resonant frequency of that individual conductor/driver. The output of the conductor/driver is maximum at this resonant frequency. At some frequency above resonance, output will be attenuated due to the mass and stiffness (damping) of the conductor, membrane, and adhesive. Frequencies below resonance are attenuated because they are below the resonant frequency.

Because the resonant frequency is inversely proportional to the square root of the mass, the mass of each conductor/driver can be selected so as to create a resonant frequency equal to or above the frequency corresponding to the length of the span at that conductor. The mass of each conductor/driver can be tailored by changing the width and/or thickness of the foil, as well as changing the thickness of the MYLAR and/or the thickness of the adhesive layers, so that the low frequency limit dictated by each span length is never exceeded.

As the apex of the membrane opening is approached, conductor lengths are shorter, resulting in proportional increases in the resonant frequencies of the corresponding conductors. However, for the more delicate very high frequencies, the inherent stiffness of the membrane/conductor materials may become significant, damping the output of the conductors. A further reduction in mass may be used to compensate for this retarding stiffness in order to produce adequate high frequency output. For example, the conductor strips may be progressively reduced from single 3/16" wide strips in the 2 KHz region to three paralleled 1/16" wide strips in the highest frequency region.

Figure 6:
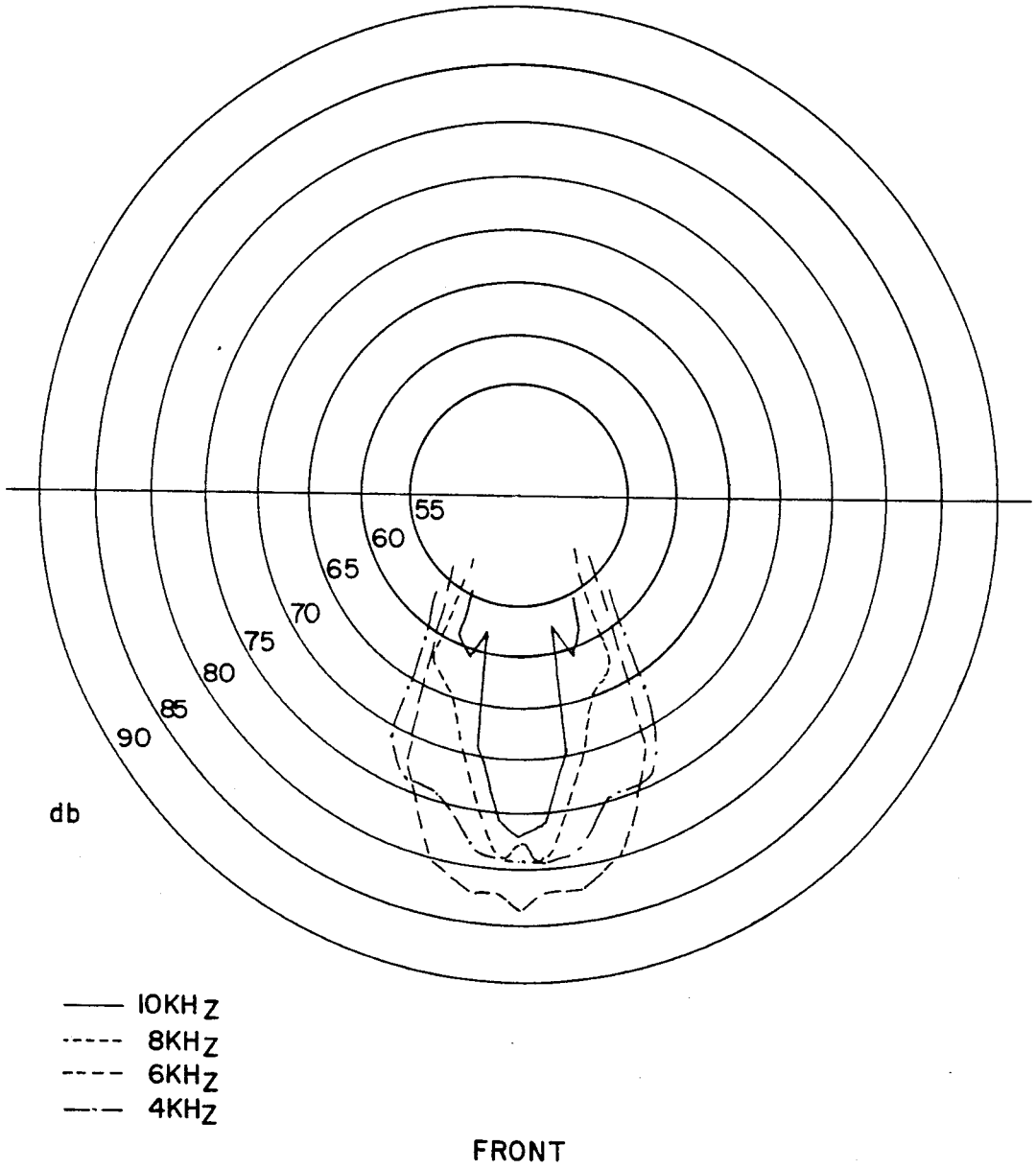
FIG. 6 is an illustration of the directional dispersion pattern at frequencies above 1400 Hz produced by the loudspeaker according to the invention.

There is shown in FIGS. 6 a polar response pattern for the loudspeaker according to the invention at frequencies of 4, 6, 8, and 10 KHz. In order to provide three-dimensional sound, the operating frequency must be above 1400 Hz. It is noted on the response patterns of FIG. 6 the general steepness of the sides of the patterns and the absence of fringe lobes. These features allow more precise orientation of the speakers relative to the sides of a listener's head, providing extremely wide separation at higher frequency. All of these features contribute to three-dimensional sound output. With the unique configuration of the membrane conductor strips relative to the support opening, the loudspeaker according to the present invention meets the teaching of mandatory directionality of frequencies above 1400 Hz. That is, with played-back sound images from the loudspeaker according to the invention, the images are all in their correct three-dimensional locations including positions out to the sides of the listener, up and down, moving toward the listener's face as well as moving away from the listener's head around and above the head, etc.

Figure 7:
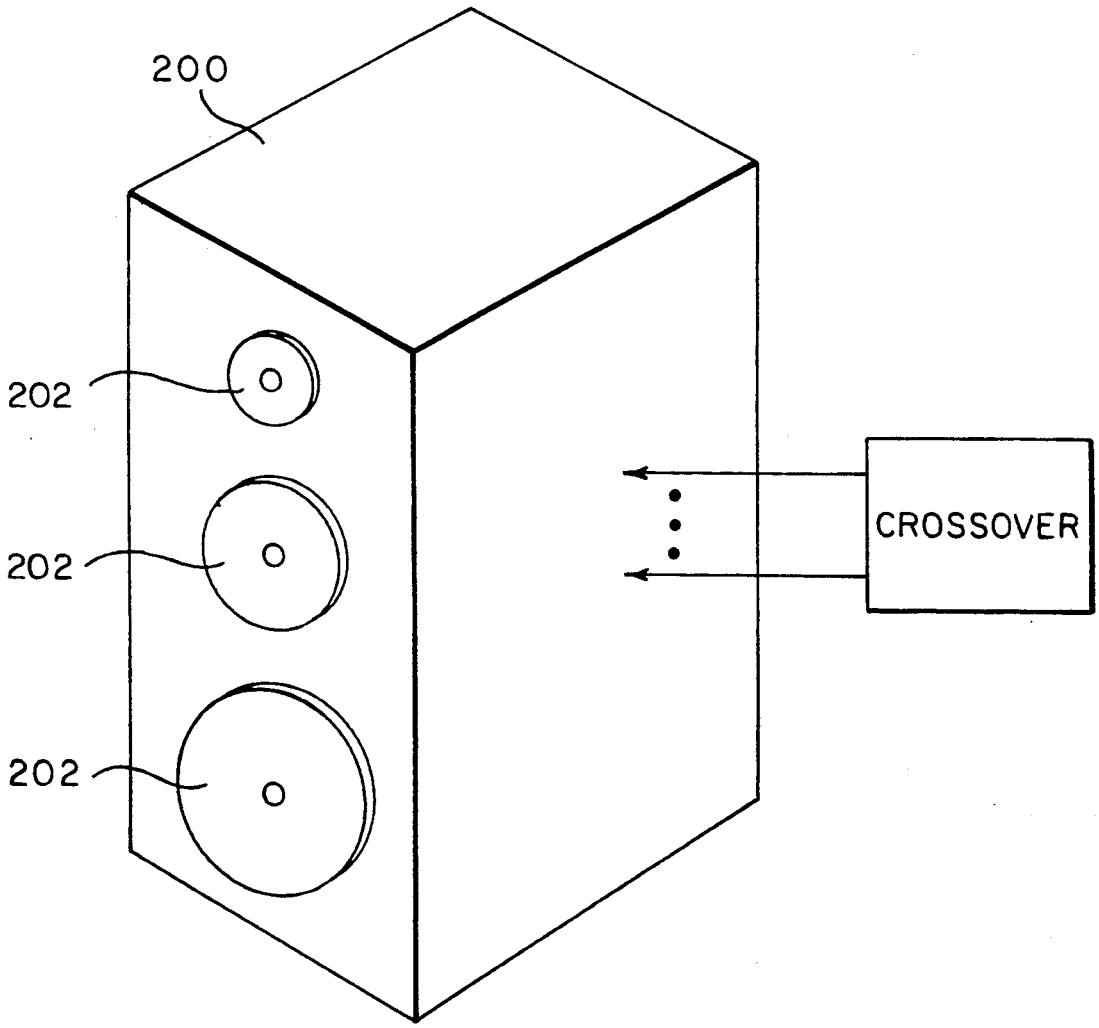
FIG. 7 is a perspective view of a loudspeaker with conical drivers for reproducing three-dimensional sound according to the invention.

As set forth above, three-dimensional imaging is not limited to membrane type loudspeakers. In loudspeakers 200 with conical drivers, 202 as shown in FIG. 7 the drivers should be lightweight and rigid for best performance. These drivers are formed for example of polypropylene or carbon fiber.

The piston diameter of the loudspeaker which reproduces frequencies at and above 1500 Hz should be 9" (corresponding approximately to a 12 inch loudspeaker), so that the reproduced frequencies are directional. The lighter the piston, the higher the frequency response of the loudspeaker before high-frequency roll-off occurs. For this example, assume that this 12 inch loudspeaker responds flatly to 4 KHz before roll-off occurs. A crossover network is then used to provide frequencies above 4 KHz to another cone driver which must have a piston diameter of at least 3.378" (approximately a 5 inch loudspeaker) to guarantee directionality. If this speaker responds to 10 KHz before beginning to roll-off, a crossover network is then used to provide frequencies above 10 KHz to another cone driver, which must have a piston diameter of at least 1.35" (approximately a 2½ inch loudspeaker) to guarantee continued directionality. For best results, these cone drivers 202 should be arranged in a vertical row on the face of the loudspeaker 200, so that no horizontal image shifting occurs as frequencies are reproduced by the different cone drivers.

While in accordance with the provisions of the patent statute the preferred forms and embodiments of the invention have been illustrated and described, it will be apparent to those skilled in the art that various changes and modifications may be made without deviating from the inventive concepts set forth above.

What is claimed is:

1. A loudspeaker for producing three dimensional stereo reproduction, comprising (a) a housing containing a tapered opening;

(b) a generally planar diaphragm mounted on said housing and extending across said opening; and (c) a plurality of vertically spaced drivers connected with said diaphragm and adapted for connection with a source of sound signal currents, each of said drivers being operable for reproducing sound within a separate and distinct frequency range above 1400 Hz, said drivers each having an operating width across said opening which determines the maximum desired wavelength of sound frequencies reproduced thereby, whereby said drivers emanate directional sound beams for improved three-dimensional sound reproduction.

2. A loudspeaker as defined in claim 1, wherein said drivers comprise a stratified thickness having vertically arranged regions of greater thickness and greater conductor mass and regions of lesser thickness and lesser conductor mass, said housing opening defining the operating width of said regions.

3. A loudspeaker for producing three dimensional stereo reproduction, comprising (a) a housing; and (b) a plurality of vertically spaced rigid conical drivers connected with said housing and adapted for connection with a source of sound signal currents, each of said drivers being operable for reproducing sound within a separate and distinct frequency range above 1400 Hz, and means to cause each of said drivers to reproduce no sound having a wavelength greater than the diameter thereof, whereby said drivers emanate directional sound beams for improved three-dimensional sound reproduction.

* * * * *